US006971818B1

(12) United States Patent
Schabacker

(10) Patent No.: US 6,971,818 B1
(45) Date of Patent: Dec. 6, 2005

(54) TACTILE WARNING SURFACES FOR WALKWAYS AND METHOD

(76) Inventor: Nolan D. Schabacker, 226 S. Price Rd., Tempe, AZ (US) 85281

( * ) Notice: Subject to any disclaimer, the term of this patent is extended or adjusted under 35 U.S.C. 154(b) by 0 days.

(21) Appl. No.: 10/762,938

(22) Filed: Jan. 22, 2004

(51) Int. Cl.[7] ..... E01C 11/24
(52) U.S. Cl. ..... 404/19; 404/21
(58) Field of Search ..... 404/6, 9, 10, 12, 404/15, 17, 19–21, 34

(56) References Cited

U.S. PATENT DOCUMENTS

| | | | | | |
|---|---|---|---|---|---|
| 1,572,854 | A | * | 2/1926 | Clark et al. | 404/19 |
| 1,647,861 | A | | 11/1927 | Furey | |
| 1,698,594 | A | | 1/1929 | Hoff | |
| 1,802,924 | A | * | 4/1931 | Myers | 404/15 |
| 1,918,336 | A | * | 7/1933 | Horni | 404/15 |
| 1,966,227 | A | * | 7/1934 | Webster | 404/15 |
| 2,321,476 | A | * | 6/1943 | Foster et al. | 404/15 |
| 3,213,584 | A | * | 10/1965 | Bush | 277/649 |
| 3,340,779 | A | * | 9/1967 | Mahoney | 404/10 |
| 3,417,676 | A | * | 12/1968 | Lenoble | 404/9 |
| 4,080,087 | A | | 3/1978 | Phillips | |
| 4,715,743 | A | | 12/1987 | Schmanski | |
| 5,271,690 | A | | 12/1993 | Fennessy | |
| 5,302,049 | A | | 4/1994 | Schmanski | |
| 5,320,790 | A | | 6/1994 | Lowe | |
| 5,775,835 | A | * | 7/1998 | Szekely | 404/34 |
| 5,822,120 | A | * | 10/1998 | Palazzotto et al. | 359/515 |
| 6,709,191 | B1 | * | 3/2004 | McCuskey | 404/19 |
| 2002/0059768 | A1 | | 5/2002 | Blount | |

* cited by examiner

*Primary Examiner*—Robert E. Pezzuto
*Assistant Examiner*—Alexandra Pechhold
(74) *Attorney, Agent, or Firm*—John D. Lister

(57) ABSTRACT

A tactile warning surface structure having underfoot detectability is formed in place by a method wherein the shank portions of a plurality pins are inserted into and bonded to a plurality of holes formed in an upper surface of a concrete slab of a walkway. The holes are located within a defined area of the upper surface of the concrete slab and are spaced from each other in a predetermined pattern so that, when the shank portions of the pins are inserted into and bonded to the holes in the concrete slab with the upper end head portions of the pins projecting upward beyond the upper surface of the concrete slab at least a minimum distance, the pins in the defined area of the upper surface of the concrete slab form a tactile warning surface having underfoot detectability.

9 Claims, 4 Drawing Sheets

FIG. 10
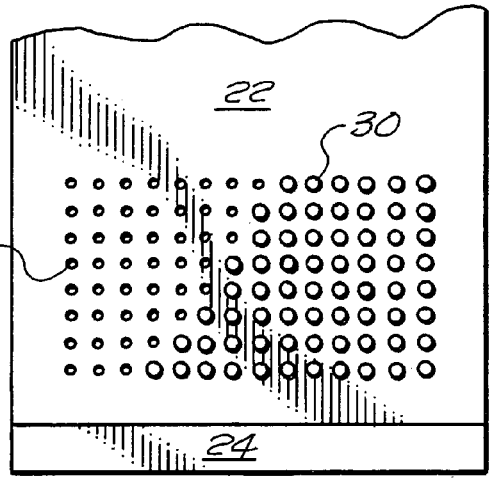
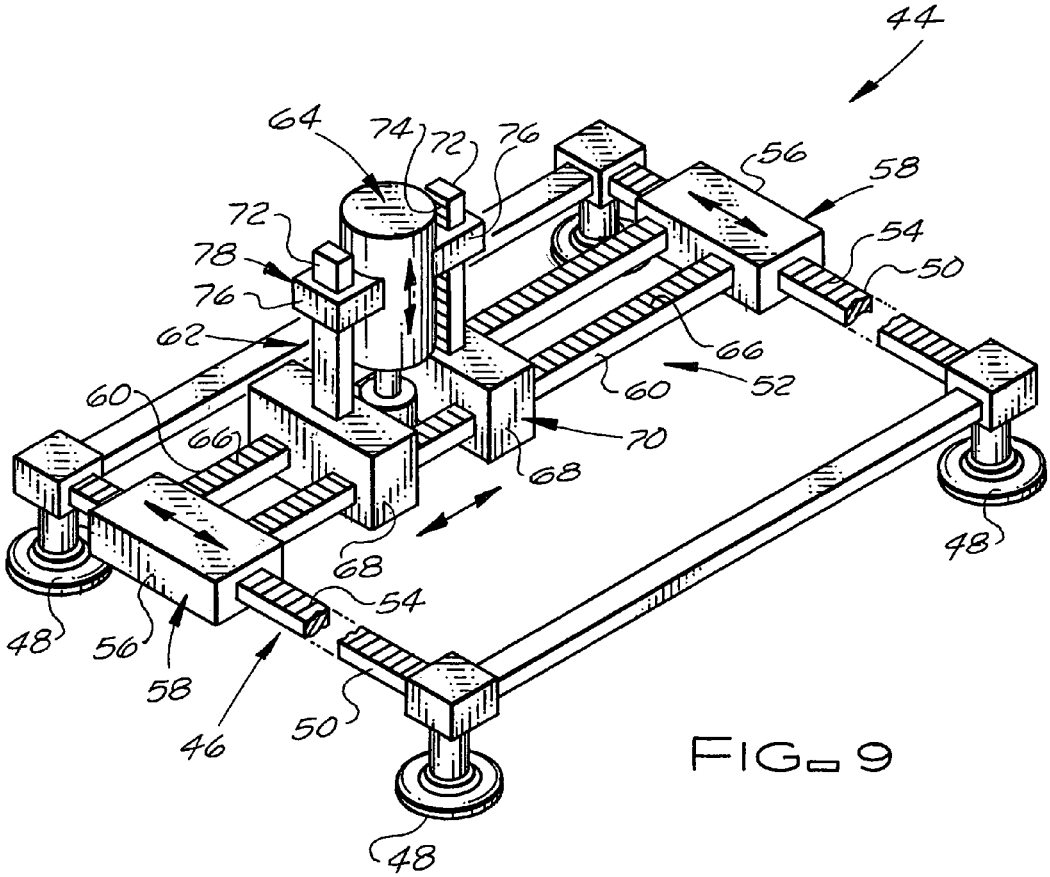
FIG. 9

TACTILE WARNING SURFACES FOR WALKWAYS AND METHOD

BACKGROUND OF THE INVENTION

The subject invention relates to tactile warning surfaces with underfoot detectability that are included in walkways for alerting the handicapped (e.g. the blind or visually impaired) and other persons that they are entering potentially hazardous areas and for safely guiding persons through the potentially hazardous areas. The subject invention also relates to an in-place method for making tactile warning surfaces in walkways at a job site. Tactile warning surfaces are used for both outdoor and indoor walkway applications (exterior and interior walkway applications) in connection with walkways formed by concrete slabs that are associated with potentially hazardous areas. For example, tactile warning surfaces are used with concrete slab walkways such as but not limited to: sidewalks; curb ramps; wheelchair ramps, pedestrian crossings; road pavement; parking lot and garage pavement; platforms of train, bus and other transit stations; platforms of stadiums, arenas, and other structures; landings for stairwells in various structures; and other outdoor and indoor walkways associated with pedestrian traffic.

Tactile warning surfaces with truncated dome projections for underfoot detectability are currently used in the walkways of public buildings, transit stations, curb ramps, pedestrian crossing, stair wells, etc., to alert the handicapped (e.g. the blind or visually impaired) and other persons that they are entering a potentially hazardous area and to safely guide persons through the potentially hazardous area. Currently, these tactile warning surfaces, which are made of concrete or polymeric compositions (e.g. synthetic rubber), are formed by molding the truncated dome projections onto the top surfaces of panels or walkway surfaces. Factory preformed, prestressed concrete tactile warning panels with stainless steel tendons and truncated dome projections molded on the top surfaces of the panels are manufactured and sold by CastinTact of Portland Oreg. U.S. Pat. Nos. 4,715,743 and 5,302,049 disclose pre-formed tactile warning panels that are molded from a flexible polymeric composition and a fiber reinforced thermosetting resin, respectively, with molded truncated dome projections on the top surfaces of the panels. These pre-formed panels are installed at the job site in new or existing concrete slab installations. However, there are problems associated with the installation of these pre-formed tactile warning panels in both new and existing concrete slab installations.

When using current installation procedures to install these pre-formed tactile warning panels in new walkway construction, a template sized and shaped to approximate the peripheral dimensions of the area in the concrete slab to receive the one or more tactile warning panels to be installed in a concrete slab is positioned on the surface of the recently poured concrete and driven down into the concrete, e.g. with a rubber mallet, while the concrete is still soft. Once the template has been driven into the recently poured soft concrete to the extent deemed appropriate by the worker per the installation instructions, the worker removes an amount of soft concrete (mud) from within the template (e.g. with a square head shovel) that the worker deems appropriate per the installation instructions to accommodate the thickness of the pre-formed tactile warning panel(s) being installed in the recessed surface formed in the concrete. After the desired amount of soft concrete has been removed from within the template and while the soft concrete remains at the required consistency to be worked, the worker smoothes the top surface of the recess formed in the soft concrete within the template and removes the template. For pre-formed concrete tactile warning panels, the worker then forms a creamy cement slurry, floats a thin layer of the creamy cement slurry on the recessed surface formed in the concrete, lays the preformed tactile warning panel(s) onto the thin layer of creamy cement slurry, and taps the pre-formed tactile warning panel(s) with the rubber mallet to ensure a bond is made with the slurry and to bring the top surface(s) of the pre-formed tactile warning panel(s) within a vertical tolerance of 0.0625 inches of the concrete surface surrounding the panel(s). This vertical tolerance of 0.0625 inches is a standard set in accordance with the Americans with Disabilities Act to eliminate a tripping hazard between the panel(s) and the surrounding concrete surface.

When installing pre-formed tactile warning panels made of polymeric compositions, such as those disclosed in U.S. Pat. Nos. 4,715,743 and 5,302,049 in new walkway construction, the same installation procedure is followed as outlined above for the pre-formed concrete tactile warning panels through the formation with the template of the recessed surface in the soft concrete. However, with preformed polymeric tactile warning panels, after the template is removed from the soft concrete, the worker allows the concrete to harden. The pre-formed polymeric tactile warning panel(s) with a flowable adhesive on the lower surface(s) are then laid onto the recessed surface and tapped with the rubber mallet to insure a bond is made with the recessed surface and to bring the top surface(s) of the pre-formed tactile warning panel(s) within a vertical tolerance of 0.0625 inches of the concrete surface surrounding the panel(s).

The above procedures require the recessed surface that receives the pre-formed tactile warning panel(s) to be formed while the concrete is still soft, are time consuming, and may require at least one panel to be cut at the job site so that the tactile warning panels cover a prescribed area. It can be even more time consuming and difficult to ensure that the upper surfaces of the tactile warning panels are laying in the same plane as each other and the surface of the surrounding concrete slab so that no lip on which a person might trip is created between the panels and/or the panels and the surface of the surrounding concrete slab. This problem is especially acute when unskilled labor is used to install the tactile warning panels.

Where an existing walkway with an existing concrete slab is to be retrofitted with either the concrete or polymeric composition pre-formed tactile warning panels, portions of the existing concrete slab must first be removed, e.g. with a jack hammer, and a recess of the desired length, width and depth formed in the slab. Once a properly sized recess has been created in the concrete slab, the pre-formed tactile warning panels can be installed by bonding the panels within the recesses as described above in connection with new walkway construction. Again the installation procedures are time consuming and may require at least one panel to be cut at the job site so that the tactile warning panels cover a prescribed area.

Concrete tactile warning surfaces have also been formed at the job site. U.S. Pat. Nos. 5,271,690 and 5,320,790 disclose tactile warning surfaces with truncated dome projections that are formed by stamping a pattern of truncated domes into the upper surface of a concrete or cementitious mortar mixture before the mixture sets. While these molded concrete tactile warning surfaces avoid many of the installation problems associated with pre-formed tactile warning panels, the molding of these tactile warning surfaces must take place shortly after the concrete is poured and before the concrete can set. In addition, if the molding of the truncated domes in the surface of the newly formed concrete slab is not performed while the concrete is at the proper consistency or if the molding operation is otherwise defective, the new concrete slab with its defective tactile warning surface may have to be removed and whole procedure may have to be repeated.

SUMMARY OF THE INVENTION

The method for forming tactile warning surfaces of the subject invention, solves the problems associated with making, transporting, and installing pre-formed tactile warning panels and the problems associated with the on site molding of tactile warning surfaces discussed above. The method for forming tactile warning surfaces of the subject invention can be applied with equal ease when providing new concrete slabs of walkways with tactile warning surfaces or retrofitting existing concrete slabs of walkways with tactile warning surfaces.

In the method of the subject invention for forming a tactile warning surface structure at a job site for new walkway construction, a concrete slab is poured and allowed to properly set at the job site in accordance with conventional industry practices. In a first preferred embodiment of the subject invention, after the concrete slab has been installed, a hole pattern template for properly and precisely locating pin receiving holes to form the tactile warning surface is positioned over the area of the slab where the tactile warning surface is to be located and, using the hole pattern of the template as a guide to locate the pin receiving holes, the pin receiving holes are drilled in the concrete. In a second preferred embodiment of the subject invention, after the concrete slab has been installed, a drilling assembly with a drilling mechanism that is indexed from position to position for properly and precisely locating pin receiving holes to form the tactile warning surface is properly positioned relative to the area of the slab where the tactile warning surface is to be located and the pin receiving holes are drilled in the concrete. After the holes are properly and precisely formed in the concrete slab, pins are inserted into the holes and bonded to the concrete slab to form the tactile warning surface in place. The holes may be drilled one or more at a time.

Preferably, the pins used in the tactile warning surface structure of the subject invention are made of a material, such as but not limited to a cementitious material, that has the same or substantially the same coefficient of thermal expansion as the concrete slab. By having the coefficient of thermal expansion of the pins and the concrete slab the same or substantially the same, the formation of cracks in the slab due to a relatively greater thermal expansion of the pins is avoided. Since a pin mad of a cementitious material will have the same or substantially the same coefficient of thermal expansion as the concrete slab and can be made to have a compressive strength equal to or greater than the compressive strength of the concrete slab, a preferred material for the pins is a cementitious material. As used in this specification and claims, the term "cementitious material" means a powder of alumina, silica, lime, iron oxide, and magnesium oxide burned together in a kiln that is finely pulverized (e.g. portland cement) and combined with water; mortar (a powder of alumina, silica, lime, iron oxide, and magnesium oxide burned together in a kiln and finely pulverized, such as portland cement, that is combined with sand and water); and/or concrete (a powder of alumina, silica, lime, iron oxide, and magnesium oxide burned together in a kiln and finely pulverized, such as portland cement, that is combined with a mineral aggregate, such as sand and gravel, and water). Preferably, the color of the upper end head portions of the pins contrasts with the color of the concrete slab to make the tactile warning surface easier to see.

When compared to the use of pre-formed tactile warning panels in new construction, the method of the subject invention for forming the tactile warning surfaces in place obviates the need to form a recess in the concrete slab with a template and work the bottom surface of the recess while the concrete is still soft to receive preformed tactile warning panels; the need to fabricate and store pre-formed tactile warning panels off site; the need to transport pre-formed tactile warning panels to job sites; and the need to position and secure pre-formed panels in place at the job site so that no lips are formed between the panels or the panels and the adjacent concrete slab. When compared to the use of tactile warning surfaces in new construction that are molded in place, the method of the subject invention for forming the tactile warning surfaces in place obviates the need for molding the tactile warning surfaces while the concrete is at the proper consistency for molding and the potential for other errors associated with the molding of the tactile warning surfaces in place, e.g. through the use of unskilled labor, that may require the slabs with their defective tactile warning surfaces to be removed and the repetition of the whole fabrication procedure. When compared to the use of preformed tactile warning panels or molded in place tactile warning surfaces in retrofit construction, in addition to the above, the method of the subject invention for forming the tactile warning surfaces in place obviates the need to form recesses in the existing concrete slabs by jack hammering or otherwise removing a portion of the existing concrete slab.

BRIEF DESCRIPTION OF THE DRAWINGS

FIG. 9 is a schematic perspective view of a drilling assembly with a drill mechanism that can be indexed from drilling position to drilling position in a desired pattern.

FIG. 10 is a schematic plan view of the concrete slab of FIG. 6 to be provided with the tactile warning surface structure of the subject invention with a pattern of holes drilled therein in accordance with the hole pattern of FIG. 5 and pins inserted into and bonded to some of the pin receiving holes.

DESCRIPTION OF THE PREFERRED EMBODIMENTS

Figure 1:
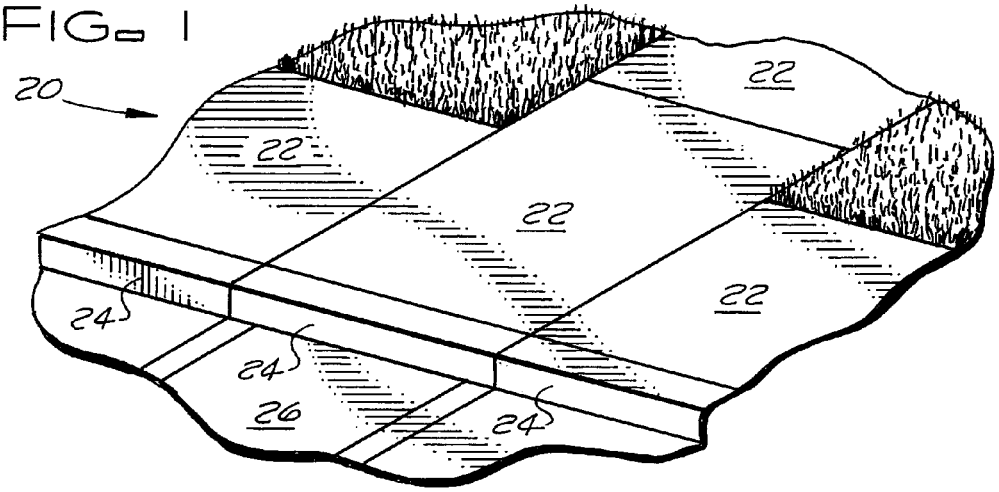
FIG. 1 is a fragmentary schematic perspective view of a sidewalk with curbing at a street crosswalk prior to the formation of a tactile warning surface structure on a concrete slab of the sidewalk.

FIG. 1 is an example of a walkway made of concrete slabs for which the method of the subject invention can be used to make a tactile warning surface structure of the subject invention. In the example shown, the walkway is a sidewalk 20 of concrete slabs 22 and a curbing 24. The sidewalk 20 is located adjacent a potentially hazardous area for people who are visually impaired or blind, in this case a pedestrian crosswalk 26 crossing a street, to warn them that they are approaching a hazardous area. The sidewalk 20 can be a newly constructed sidewalk, provided the concrete of the slabs 22 has sufficiently set and cured to permit drilling, or the sidewalk can be an existing sidewalk being retrofitted with a tactile warning surface.

Figure 2:
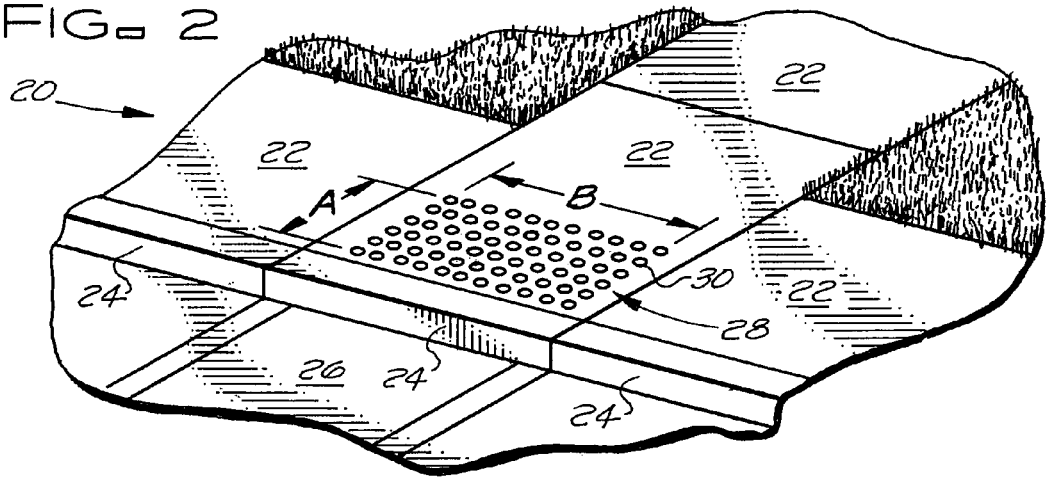
FIG. 2 is a fragmentary schematic perspective view of the sidewalk of FIG. 1 after the formation on a concrete slab of the sidewalk of a tactile warning surface structure of the subject invention that has underfoot detectability.

FIG. 2 shows the sidewalk 20 of FIG. 1 with a tactile warning surface structure 28 of the subject invention installed in a concrete slab 22 of the sidewalk that is located adjacent the crosswalk 26. The tactile warning surface structure 28 is formed by a plurality of pins 30, such as but not limited to the pins of FIGS. 11 to 16, that are bonded or otherwise anchored to the concrete slab 22 with upper end head portions of the pins projecting above the top surface of the concrete slab in a pattern that forms a structure that has underfoot detectability to warn a person stepping onto the tactile warning surface that he/she is approaching a potentially hazardous area.

Figure 3:
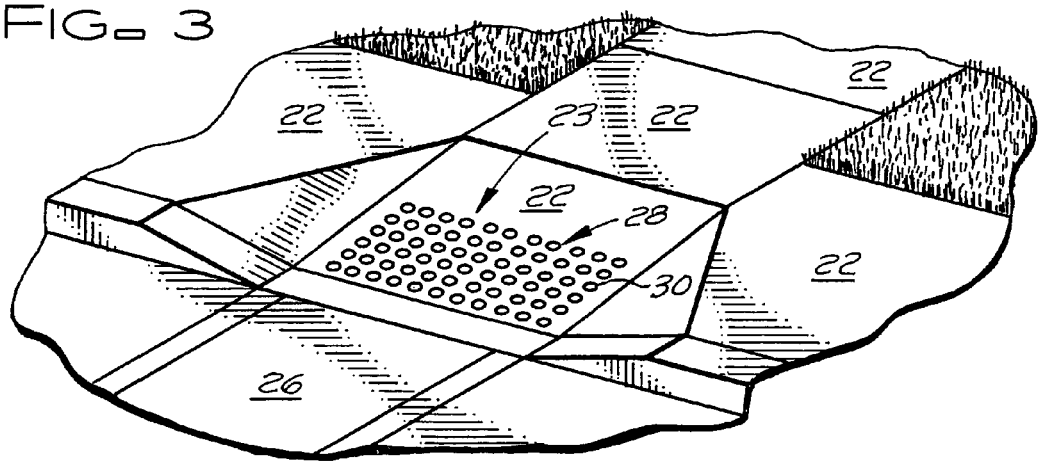
FIG. 3 is a fragmentary schematic perspective view of a sidewalk that is similar to the sidewalk of FIG. 1, but which has a ramp. Like the sidewalk of FIG. 2, the sidewalk of FIG. 3 has a tactile warning surface structure of the subject invention that has underfoot detectability formed on a concrete slab of the sidewalk.

FIG. 3 shows a sidewalk similar to the sidewalk 20 of FIG. 1, but with one of its concrete slabs 22 forming a ramp 23 with a tactile warning surface structure 28 of the subject invention installed in the concrete slab 22 forming the ramp 23. The ramp 23 is located adjacent the crosswalk 26. The tactile warning surface structure 28 is formed by a plurality of pins 30, such as but not limited to the pins of FIGS. 11 to 16, that are bonded or otherwise anchored to the concrete slab 22 with upper nd head portions of the pins projecting above the top surface of the concrete slab in a pattern that forms a structure that has underfoot detectability to warn a person stepping onto the tactile warning surface that he/she is approaching a potentially hazardous area.

Figure 4:
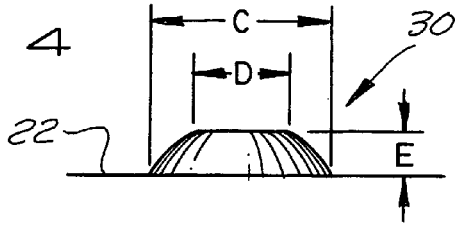
FIG. 4 is a side view of a raised truncated dome of the tactile warning surface structures of FIGS. 2 and 3 that meets standards set by the Americans with Disabilities Act.

Preferably, in accordance with standards set in accordance with the Americans with Disabilities Act for providing a tactile warning surface with underfoot detectability: a) the tactile warning surface structure 28 is located in a concrete slab so that a peripheral edge of the tactile warning surface of the structure is within 6 to 8 inches (150 to 205 mm) of a curb line or other potential hazard; b) the tactile warning surface structure 28 is at least 2 feet (0.6 m) in depth ("A" in FIG. 2) by 3 feet (0.9 m) in width ("B" in FIG. 2); c) the tactile warning surface structure 28 is formed by raised truncated domes that each have a 0.90 inch (23 mm) base diameter ("C" in FIG. 4), a 0.45 inch (12 mm) upper surface diameter ("D" in FIG. 4), and a 0.20 inch (5 mm) height from the base to the upper surface ("E" in FIG. 4); and d) the raised truncated domes of the tactile warning surface structure 28 are arranged in a repetitive square pattern which has a center-to-center spacing between the truncated domes along each side of each square in the pattern ("F" in FIG. 5) of 2.35 inches (60 mm) and a center-to-center diagonal spacing between the truncated domes of each square in the pattern ("G" in FIG. 5) of 3.32 inches (85 mm). While it is preferred that the tactile warning surface structure 28 conform to standards set in accordance with the Americans with Disabilities Act, for certain applications it is contemplated that the tactile warning surface structure 28 need not conform to standards set in accordance with the Americans with Disabilities Act provided the surface of the structure exhibits underfoot detectability.

In the method of the subject invention for making the tactile warning surface structure 28, the location, shape, and size of the area 32 of a concrete slab 22 to be provided with a tactile warning surface structure 28 is selected. Pin receiving holes 34, in a selected pattern with selected center-to-center spacings, are then drilled one or more at a time within the selected area 32 of the concrete slab to a depth sufficient to receive the shanks of the pins 30 that will form the tactile warning surface of the tactile warning surface structure 28. While the placement of the pin receiving holes 34 within the selected area 32 of the slab can be accomplished in various ways (including, provided the pin receiving holes are accurately located, the use of a tape measure to measure the center-to-center spacings between the pin receiving holes), the procedures set forth below in connection with FIGS. 6 to 10 are preferred. Once the pin receiving holes 34 have been formed in the selected area 32 of the concrete slab 22, the shanks of pins 30 (such as but not limited to the pins shown in FIGS. 11 to 16) that are to form the tactile warning surface structure 28 are then inserted into and bonded to the pin receiving holes so that upper end portions of the pins project a selected distance above the top surface of the concrete slab to form a tactile warning surface with underfoot detectability. While the bonding agent (preferably, a thermoplastic or thermosetting polymeric adhesive) bonding the shank portions of the pins 30 to the holes 34 can be applied to the sidewalls of the holes, preferably, the bonding agent is applied to the shank portions of the pins and then the pins are inserted into the pin receiving holes.

Figure 5:
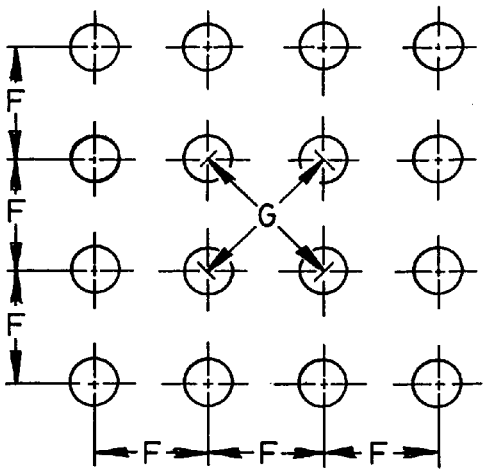
FIG. 5 is a plan view of the raised truncated domes of a portion of the tactile warning surface structures of FIGS. 2 and 3 with the raised truncated domes set in a pattern that meets standards set by the Americans with Disabilities Act.
Figure 6:
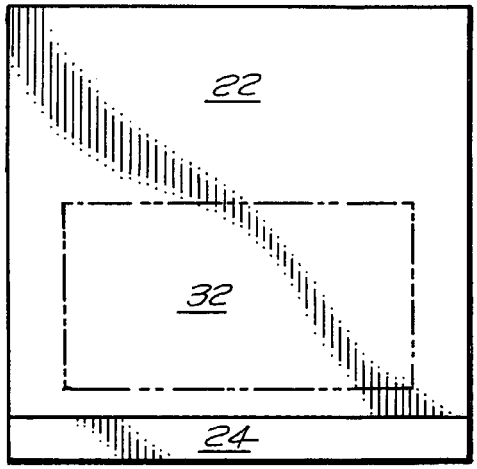
FIG. 6 is a schematic plan view of the concrete slab of FIG. 1 that is to be provided with the tactile warning surface structure of the subject invention with the area of the slab surface that is to receive the tactile warning surface structure outlined by a dashed line.
Figure 7:
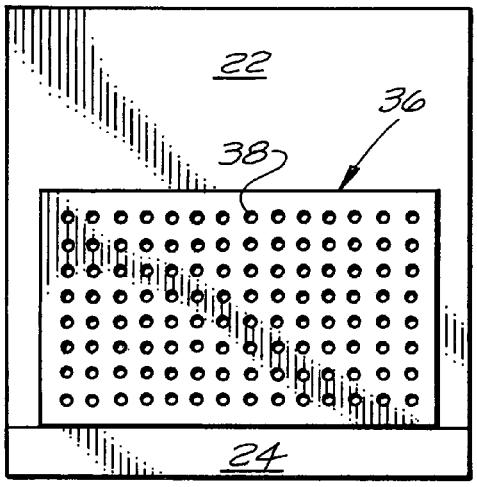
FIG. 7 is a schematic plan view of the concrete slab of FIG. 6 that is to be provided with the tactile warning surface structure of the subject invention with a first hole pattern template for use in the drilling of pin receiving holes in the slab placed over the area of the surface outlined by the dashed line in FIG. 6.

FIGS. 6, 7, and 10 schematically show the method of the subject invention for making the tactile warning surface structure 28 of the subject invention being carried out with the use of a first hole pattern template 36. Preferably, the template 36 is provided with a plurality of holes 38 that are arranged in a desired pattern and center-to-center hole spacing to locate the pin receiving holes 34 of the tactile warning surface structure 28 in the desired locations, such as but not limited to a hole pattern and center-to-center hole spacing that locates the pins as shown in FIG. 5.

As shown by the dashed line in FIG. 6, the location, shape and size of the area 32 where the tactile warning surface structure 28 is to be installed on a concrete slab 22 are selected. As shown in FIG. 7, the template 36 is placed over the area 32 where the tactile warning surface structure 28 is to be constructed. With the hole-locating template 36 in place, a marking medium that contrasts with the color of the concrete surface of the slab 22 so that the marking medium can be easily seen, is applied to the concrete surface through the holes 38 of the template to mark the concrete surface where the holes 34 for the pins 30 are to be drilled. For example, once the hole-locating template 36 is in place, a black or red paint can be quickly and easily sprayed through the holes 38 to form the markings on the surface of the concrete slab 22. While the holes 38 in the hole-locating template 36 may differ in diameter from the diameter of the holes to be drilled into the concrete slab for receiving the pins that form the tactile warning surface, preferably, the holes 38 are the same or substantially the same diameter as the diameter of the holes 34 to be drilled in the concrete slab 22 for the pins 30 of the tactile warning surface structure 28 so that the markings are easily seen and easy to use for properly locating the drill bit forming the holes in the slab. Where the holes 38 in the hole-locating template 36 are sized to accommodate a drill bit sized to form holes 34 to accommodate the shanks of the pins 30 to be inserted into the holes to form the tactile warning surface structure 28, the template 36 may be located over the area 32 and the holes 34 drilled into the concrete slab 22 while the template is in place without marking the surface of the concrete slab.

The hole-locating template 36 may be a reusable template, e.g. a template made of stainless steel, aluminum, or durable plastic sheet material, or a throw away template, e.g. a template made of a paperboard, plastic, or foil sheet material. The hole-locating template 36 may also be provided with an adhesive layer or suction cups on the bottom major surface of the template for temporarily securing the template in place while the locations for the holes 34 are being marked on the surface of the concrete slab or the holes 34 are being drilled in the concrete slab through the holes in the template. Where an adhesive is used to temporarily secure the template 36 in place on the concrete slab 22, preferably, the adhesive is a water soluble adhesive or other adhesive that can be quickly and easily removed from the surface of the concrete slab after the template is removed.

Once the holes 34 for the pins 30 have been properly located and drilled in the area 32 using the template 36, an adhesive is applied either to the shanks of the pins 30 or the sides of the holes 34 (preferably, the shanks of the pins) and the shanks of the pins 30 are inserted into and bonded to the holes 34. FIG. 10 shows the process of inserting and bonding the shanks of the pins 30 to the holes 34 drilled in the area 32 to form the tactile warning surface structure 28 about half completed. The shanks of a plurality of pins 30 have been inserted into and bonded to about half of the holes 34 that have been drilled in the area 32 of the concrete slab 22.

Figure 8:
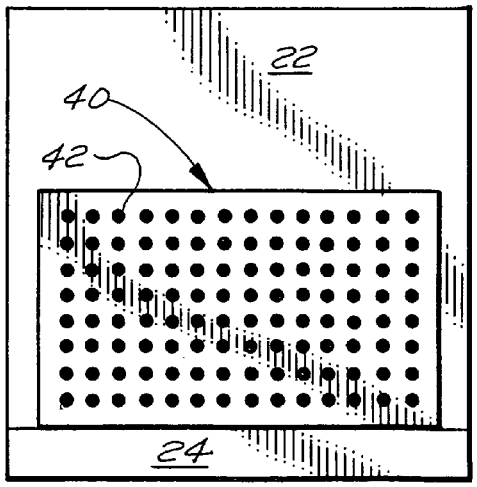
FIG. 8 is a schematic plan view of the concrete slab of FIG. 6 to be provided with the tactile warning surface with a second hole pattern template for use in the drilling of pin receiving holes in the slab placed over the location of the surface outlined by the dashed line in FIG. 6.

FIGS. 6, 8, and 10 schematically show the method of the subject invention for making the tactile warning surface structure 28 of the subject invention being carried out with the use of a second hole pattern template 40. Preferably, the template 40 is provided with a plurality of easily seen markings 42 (e.g. solid circular black or red markings on a white background) that are arranged in a desired pattern and center-to-center hole spacing to locate the pin receiving holes 34 of the tactile warning surface structure 28 in the desired locations, such as but not limited to a hole pattern and center-to-center hole spacing that locates the pins 30 as shown in FIG. 5.

As shown by the dashed line in FIG. 6, the location, shape and size of the area 32 where the tactile warning surface structure 28 is to be installed on a concrete slab 22 are selected. As shown in FIG. 8, the template 40 is placed over the area 32 where the tactile warning surface structure 28 is to be constructed. While the markings 42 on the hole-locating template 40 may differ in diameter from the diameter of the holes 34 to be drilled into the concrete slab 22 for receiving the pins 30 that form the tactile warning surface structure 28, preferably, the markings 42 are the same or substantially the same diameter as the diameter of the holes 34 to be drilled in the concrete slab 22 for the pins 30 of the tactile warning surface structure 28 so that the markings 42 are easily seen and easy to use for properly locating the drill bit forming the holes in the slab. With the hole-locating template 40 temporarily secured in place, the holes 34 are drilled into the concrete slab 22 while the template is in place by drilling through the template at the markings 42 on the template. The hole-locating template 40 is a throw away template, e.g. a template made of a paperboard, plastic, or foil sheet material that is used for the installation of one tactile warning surface structure and then discarded. Preferably, the hole-locating template 40 is provided with an adhesive layer, suction cups or other means on the bottom major surface of the template for temporarily securing the template in place while the holes 34 are being drilled in the concrete slab through the markings on the template. Where an adhesive is used to temporarily bond the template to the surface of the concrete slab 22, preferably, the adhesive is a water soluble adhesive or other adhesive that can be quickly and easily removed from the surface of the concrete slab after the template is removed.

Once the holes 34 for the pins 30 have been located and drilled in the area 32 using the template 40, an adhesive is applied either to the shanks of the pins 30 or the sides of the holes 34 (preferably, the shanks of the pins) and the shanks of the pins 30 are inserted into and bonded to the holes 34. FIG. 10 shows the process of inserting and bonding the shanks of the pins 30 to the holes 34 drilled in the area 32 to form the tactile warning surface structure 28 about half completed. The shanks of a plurality of pins 30 have been inserted into and bonded to about half of the holes 34 that have been drilled in the area 32 of the concrete slab 22.

FIG. 9 is representative of a drilling assembly 44 for drilling the holes 34 in a selected pattern, such as but not limited to the pattern illustrated in FIG. 5, in the area 32 of a concrete slab 22 to receive the shanks of the pins 30 of the tactile warning surface structure 28. As shown, the drilling assembly 44 has a main frame 46 that can be temporarily secured to the surface of a concrete slab 22 with conventional suction cup assemblies 48 or other securing means that will retain the drilling assembly in place while the assembly is used to drill holes 34. The main frame 46 includes two lateral rails 50 that carry a subframe 52. The lateral rails 50 each have teeth 54 on their upper surfaces for gearing with a hydraulically driven pinion or worm gear assembly 56 mounted on the subframe 52 to form a conventional hydraulic drive assembly 58. The conventional hydraulic drive assembly 58 is used to mount the subframe 52 on the lateral rails 50 of the main frame 46 so that the subframe can be moved back and forth in a first generally horizontal direction along the rails 50.

The subframe 52 includes two cross rails 60 that carry a tool mounting frame 62 for a drill and bit mechanism 64. The cross rails 60 each have teeth 66 on their upper surfaces for gearing with a hydraulically driven pinion or worm gear assembly 68 mounted on the tool mounting frame 62 to form a conventional hydraulic drive assembly 70. The conventional hydraulic drive assembly 70 is used to mount the tool frame 62 on the cross rails 60 of the subframe 52 so that the tool frame 62 can be moved back and forth in a second generally horizontal direction along the cross rails 60 that is perpendicular to the movement of the subframe in first direction along the lateral rails 50. Thus, the subframe 52 can be moved along the lateral rails 50 and the tool frame can be moved along the cross rails 60 to locate the drill and bit mechanism 64 anywhere over a drilling area encompassed within the main frame 46 for the purpose of drilling holes 34 within the drilling area encompassed within the main frame 46.

The tool frame 62 includes generally vertically extending rails 72 that carry the drill and bit mechanism 64. The vertically extending rails 72 each have teeth 74 on one of their vertically extending surfaces for gearing with a hydraulically driven pinion or worm gear assembly 76 mounted on the drill and bit mechanism 64 to form a conventional hydraulic drive assembly 78. The conventional hydraulic drive assembly 78 is used to mount the drill and bit mechanism 64 on the vertically extending rails 72 of the tool frame 62 so that the drill and bit mechanism 64 can be moved back and forth vertically in a third direction along the vertically extending rails 72 to drill holes 34 in the concrete slab 22.

The drill and bit mechanism 64 of the drilling assembly 44 can be indexed from location to location in a predetermined pattern (such as but not limited to the pattern shown in FIG. 5) within drilling area defined by the main frame 46 of the drilling assembly and used to drill the holes 34 by using conventional manual hydraulic control mechanisms. However, preferably, the drill and bit mechanism 64 of the drilling assembly 44 is automatically indexed from location to location in a predetermined pattern (such as but not limited to the pattern shown in FIG. 5) within drilling area defined by the main frame of the drilling assembly and used to drill the holes 34 by using conventional computer controlled hydraulic control mechanisms. The conventional hydraulic hoses connecting the drives to a source of pressurized hydraulic fluid are not shown and it is contemplated that the drives for the drilling assembly 44 could be driven by electric motors.

Once the holes 34 for the pins 30 have been located and drilled in the area 32 using the drilling assembly 44, an adhesive is applied either to the shanks of the pins 30 or the sides of the holes 34 (preferably, the shanks of the pins) and the shanks of the pins 30 are inserted into and bonded to the holes 34. FIG. 10 shows the process of inserting and bonding the shanks of the pins 30 to the holes 34 drilled in the area 32 to form the tactile warning surface structure 28 about half completed. The shanks of a plurality of pins 30 have been inserted into and bonded to about half of the holes 34 that have been drilled in the area 32 of the concrete slab 22.

FIGS. 11 to 16 show a number of pins that can be used as the pins 30 and holes of different configurations for the pins that can be used as the holes 34 to receive the pins and form the tactile warning surface structure 28. Preferably, the pins 30 (including the specific pins of FIGS. 11 to 16) have truncated dome shaped upper end portions with dimensions such as those set forth in the description of FIG. 4; have a color that contrasts with the concrete slab (dark on light or light on dark) and that is an integral part of the pin; and are made of a durable, high strength, high impact, wear resistant, ultraviolet ray resistant, material such as a cementitious material or a hard, corrosion resistant metal such as but not limited to stainless steel. Preferably, each of the pins 30 (including each of the pins of FIGS. 11 to 16) has a compressive strength substantially equal to or greater than the compressive strength of the concrete slab 22 and exhibits a compressive strength of at least 8,700 to 10,000 pounds per square inch. Most preferably, the pins 30 are made of a cementitious material so that the pins are inexpensive, exhibit the desired compressive strength, and the same or substantially the same coefficient of thermal expansion as the concrete slab housing the shanks of the pins. Preferably, the shanks of the pins 30 (including each of the pins of FIGS. 11 to 16) range from about 0.70 to about 0.90 inches in diameter and from about 1.10 to about 1.25 inches in length from the base of the upper end head portion of the pin to the bottom surface of the pin. Preferably, a commercially available thermoplastic or thermosetting adhesive, such as but not limited to an epoxy adhesive, is used to bond the shanks of the pins 30 to the holes 34 in the concrete slab 22.

Figure 11:
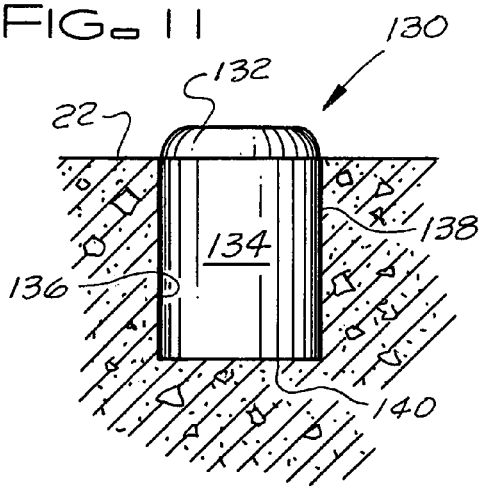
FIGS. 11 to 16 are vertical transverse cross sections through pin receiving holes for receiving pins forming a tactile warning surface structure of the subject invention with different types of pins inserted into and bonded within the holes.

The pin 130 of FIG. 11 has a truncated dome shaped upper end head portion 132 with a base that has a diameter equal to or substantially equal to the diameter of the shank portion 134 of the pin. The shank portion 134 of the pin is adhesively bonded to the hole 136 with an adhesive 138 and the truncated dome shaped upper end head portion 132 of the pin projects above the upper surface of the concrete slab 22 to form a component of the tactile warning surface structure 28. Preferably, the pin 130 is greater in length than the depth of the hole 136 and the bottom surface 140 of the pin is in contact with the bottom surface of the hole 136 to thereby set the height that the upper end head portion 132 of the pin 130 projects above the surface of the concrete slab 22.

Figure 12:
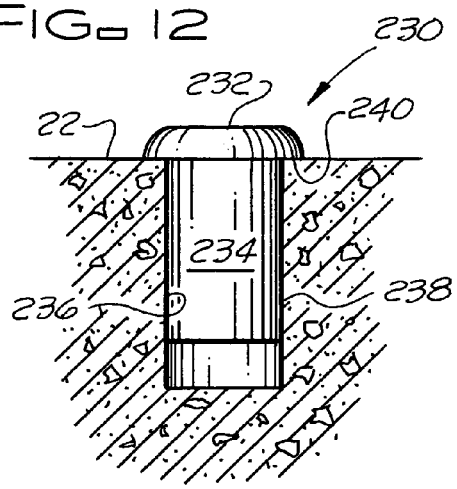

The pin 230 of FIG. 12 has a truncated dome shaped upper end head portion 232 with a base that has a diameter greater than the diameter of the shank portion 234 of the pin and the hole 236. The shank portion 234 of the pin is adhesively bonded to the hole 236 with an adhesive 238 and the truncated dome shaped upper end head portion 232 of the pin projects above the upper surface of the concrete slab 22 to form a component of the tactile warning surface structure 28. The base surface 240 of upper end head portion 232 of the pin 230 is in contact with the surface of the concrete slab 22 to thereby set the height that the upper end head portion 232 of the pin 230 projects above the surface of the concrete slab 22.

Figure 13:
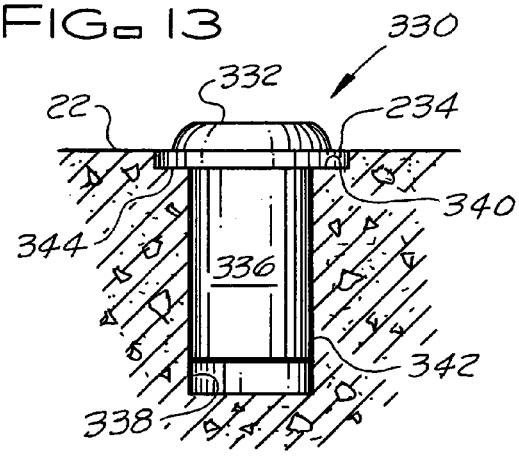

The pin 330 of FIG. 13 has a truncated dome shaped upper end head portion 332 with an annular flange 334 at its base that has a diameter greater than the diameter of the shank portion 336 of the pin. The hole 338 has an upper countersunk portion 340 that has substantially the same diameter as the annular flange 334 and a lower portion that has a diameter substantially the same as the shank portion 336 of the pin 330. The shank portion 336 of the pin is adhesively bonded to the hole 338 with an adhesive 342 and the truncated dome shaped upper end head portion 332 of the pin projects above the upper surface of the concrete slab 22 to form a component of the tactile warning surface structure 28. The base surface 344 of the annular flange 334 at the base of upper end head portion 332 of the pin 230 is in contact with the countersunk surface of the hole 338 in the concrete slab 22 to thereby set the height that the upper end head portion 332 of the pin 330 projects above the surface of the concrete slab 22.

Figure 14:
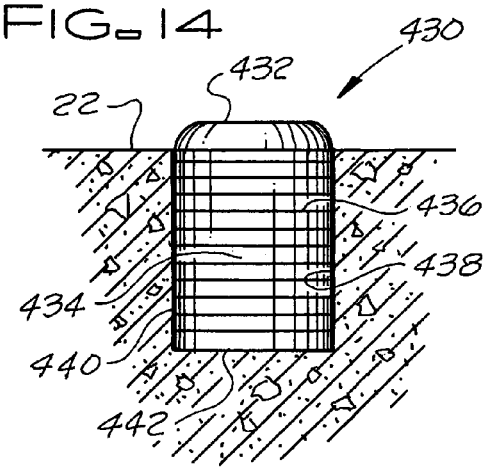

The pin 430 of FIG. 14 has a truncated dome shaped upper end head portion 432 with a base that has a diameter equal to or substantially equal to the diameter of the shank portion 434 of the pin. The shank portion 434 of the pin has a serrated surface 436 formed by generally horizontally or spirally extending ribs or grooves and is adhesively bonded to the hole 438 with an adhesive 440. The serrated surface 436 is utilized to form a better bonding surface on the pin 430 for the adhesive 440. The truncated dome shaped upper end head portion 432 of the pin projects above the upper surface of the concrete slab 22 to form a component of the tactile warning surface structure 28. Preferably, the pin 430 is greater in length than the depth of the hole 438 and the bottom surface 442 of the pin is in contact with the bottom surface of the hole 438 to thereby set the height that the upper end head portion 432 of the pin 430 projects above the surface of the concrete slab 22. The serrated surface of pin 430 can also be used on any of the other pins shown in FIGS. 11 to 16.

Figure 15:
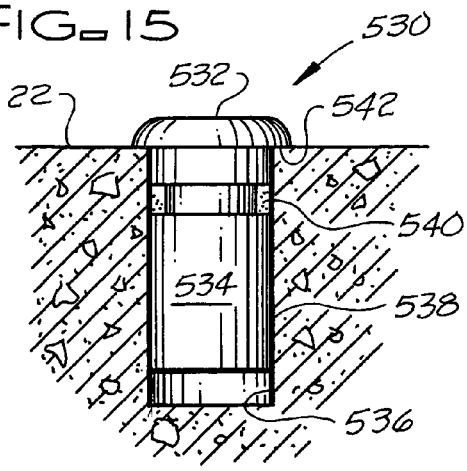

The pin 530 of FIG. 15 has a truncated dome shaped upper end head portion 532 with a base that has a diameter greater than the diameter of the shank portion 534 of the pin and the hole 536. The shank portion 534 of the pin is adhesively bonded to the hole 536 with an adhesive 538 and the truncated dome shaped upper end head portion 532 of the pin projects above the upper surface of the concrete slab 22 to form a component of the tactile warning surface structure 28. The shank portion 534 of the pin 530 is provided with an annular groove 540 to provide a reservoir into and out of which adhesive can flow should there be relative expansion and/or contraction between the pin 530 and the hole 536. The base surface 542 of upper end head portion 532 of the pin 530 is in contact with the surface of the concrete slab 22 to thereby set the height that the upper end head portion 532 of the pin 530 projects above the surface of the concrete slab 22. A groove can also be used in the shanks of the other pins of FIGS. 11 to 16 to function as a reservoir for the adhesive bonding the pins to the holes.

Figure 16:
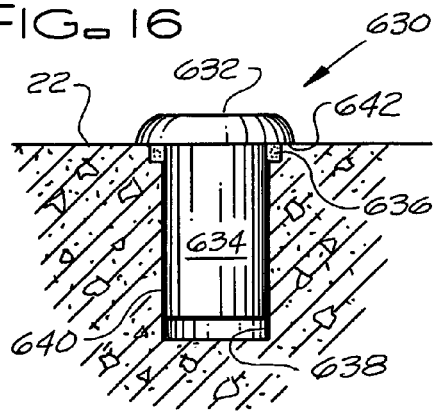

The pin 630 of FIG. 16 has a truncated dome shaped upper end head portion 632 with a base that has a diameter greater than the diameter of the shank portion 634 of the pin and a countersunk upper end portion 636 of the hole 638. The shank portion 634 of the pin is adhesively bonded to the hole 638 with an adhesive 640 and the truncated dome shaped upper end head portion 632 of the pin projects above the upper surface of the concrete slab 22 to form a component of the tactile warning surface structure 28. The countersunk upper end portion 636 of the hole 638 provides a reservoir into and out of which adhesive can flow should there be relative expansion and/or contraction between the pin 630 and the hole 638. The base surface 642 of upper end head portion 632 of the pin 630 is in contact with the surface of the concrete slab 22 to thereby set the height that the upper end head portion 632 of the pin 630 projects above the surface of the concrete slab 22.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A method of forming a tactile walking surface structure in place having underfoot detectability, comprising:

providing a plurality of pins, the pins each having an upper end head portion and a shank portion; the shank portion of each of the pins having a diameter and a length; the upper end head portion of each of the pins having a greater diameter than the diameter of the shank portion of each of the pins;

placing a template on an upper surface of a concrete slab of a walkway; the template having a selected repetitive pattern for establishing locations on the upper surface of the concrete slab for drilling holes in the concrete slab to receive the shank portions of the pins;

using the template for determining the location of the holes in the upper surface of the concrete slab of the walkway and drilling the holes in the upper surface of the concrete slab in the selected repetitive pattern of the template; the holes each having a diameter sized to receive the shank portion of one of the pins that is less in diameter than the diameter of the upper end head portions of the pins; the holes each being drilled to a greater depth than the length of the shank portion of each of the pins so that the height of the upper end head portion of each of the pins above the upper surface of the concrete slab is a preselected minimum distance when the upper end head portion of the pin is resting on the upper surface of the concrete slab; the holes being located within a defined area of the upper surface of the concrete slab that is at least one foot in width by at least two feet in length; the holes being spaced from each other in the selected repetitive pattern of the template so that, when the shank portions of the pins are inserted into the holes and bonded to the concrete slab with the upper end head portions of the pins projecting upward beyond the upper surface of the concrete slab at least the minimum distance, the upper end head portions of the pins in the defined area of the upper surface of the concrete slab form a walking surface having underfoot detectability;

inserting the shank portions of the pins into the holes with the upper end head portions of the pins resting on the upper surface of the concrete slab and projecting upward beyond the upper surface of the concrete slab at least the minimum distance; and bonding the inserted pins to the concrete slab to form a walking surface having underfoot detectability.

2. The method of forming a tactile walking surface structure in place having underfoot detectability according to claim 1, wherein:

the area is at least two feet in width by at least three feet in length.

3. The method of forming a tactile walking surface structure in place having underfoot detectability according to claim 2, wherein:

the selected repetitive pattern formed using the template is a repetitive square pattern of rows and columns with a center-to-center spacing between adjacent holes in each row and each column of the pattern being about 2.35 inches and a diagonal center-to-center spacing between the holes forming each square of the pattern being about 3.32 inches; and the upper end head portions of the pins project upward beyond the upper surface of the concrete slab at least the minimum distance of 0.20 inches.

4. The method of forming a tactile walking surface structure in place having underfoot detectability according to claim 3, wherein:

the upper end head portion of each of the pins is truncated dome.

5. The method of forming a tactile walking surface structure in place having underfoot detectability according to claim 4, wherein:

the concrete slab has a compressive strength; each of the pins has a compressive strength substantially equal to or greater than the compressive strength of the concrete slab; each of the pins is made of a cementitious material, and each of the pins has substantially the same coefficient of thermal expansion as the concrete slab.

6. The method of forming a tactile walking surface structure in place having underfoot detectability according to claim 5, including:

bonding each of the pins to the hole within which the shank portion of the pin is inserted with a thermoplastic or thermosetting polymeric adhesive.

7. The method of forming a tactile walking surface structure in place having underfoot detectability according to claim 4, wherein:

the concrete slab has a compressive strength; each of the pins has a compressive strength substantially equal to or greater than the compressive strength of the concrete slab; and each of the pins is made of a corrosion resistant metal.

8. The method of forming a tactile walking surface structure in place having underfoot detectability according to claim 7, including:

bonding each of the pins to the hole within which the shank portion of the pin is inserted with a thermoplastic or thermosetting polymeric adhesive.

9. The method of forming a tactile walking surface structure in place having underfoot detectability according to claim 8, including:

creating a reservoir between each hole formed in the concrete slab and the pin inserted into the hole for accommodating adhesive flow caused by relative expansion and contraction between the hole in the concrete slab and the pin.

* * * * *